US007182237B2

(12) United States Patent
Akiba

(10) Patent No.: US 7,182,237 B2
(45) Date of Patent: Feb. 27, 2007

(54) COMBUSTION TYPE POWER TOOL HAVING SEGMENTAL CONNECTION UNIT

(75) Inventor: Yoshitaka Akiba, Hitachinaka (JP)

(73) Assignee: Hitachi Koki Co., Ltd., Tokyo (JP)

( * ) Notice: Subject to any disclaimer, the term of this patent is extended or adjusted under 35 U.S.C. 154(b) by 0 days.

(21) Appl. No.: 11/032,052

(22) Filed: Jan. 11, 2005

(65) Prior Publication Data

US 2005/0167464 A1 Aug. 4, 2005

(30) Foreign Application Priority Data

Jan. 30, 2004 (JP) ..... P2004-023117

(51) Int. Cl.
*B25C 1/08* (2006.01)

(52) U.S. Cl. ..... 227/10; 227/8; 227/9; 227/11; 227/142

(58) Field of Classification Search ..... 227/8–11, 227/130, 142; 123/465 C
See application file for complete search history.

(56) References Cited

U.S. PATENT DOCUMENTS 4,403,722 A 9/1983 Nikolich et al.
4,821,937 A * 4/1989 Rafferty ..... 227/8
5,197,646 A 3/1993 Nikolich et al.
5,263,626 A * 11/1993 Howard et al. ..... 227/8
5,685,473 A * 11/1997 Shkolnikov et al. ..... 227/8
5,909,836 A * 6/1999 Shkolnikov et al. ..... 227/8
6,024,267 A * 2/2000 Chen ..... 227/8
6,138,887 A * 10/2000 Nayrac et al. ..... 227/8
6,581,815 B1 * 6/2003 Ho et al. ..... 227/8
6,830,017 B2 * 12/2004 Wolf et al. ..... 123/46 R
6,851,595 B1 * 2/2005 Lee ..... 227/8
6,886,730 B2 * 5/2005 Fujisawa et al. ..... 227/8
6,951,194 B2 * 10/2005 Nishikawa et al. ..... 227/10
6,964,362 B2 * 11/2005 Shkolnikov et al. ..... 227/130
7,036,704 B2 * 5/2006 Nayrac et al. ..... 227/10
2002/0121540 A1 * 9/2002 Taylor et al. ..... 227/8

* cited by examiner

*Primary Examiner*—John Sipos
*Assistant Examiner*—Michelle Lopez
(74) *Attorney, Agent, or Firm*—Antonelli, Terry, Stout and Kraus, LLP.

(57) ABSTRACT

A combustion type power tool providing enhanced workability and improved material yieldability. A combustion chamber frame is slidably movably disposed in a housing. A push lever is slidably movably supported to a nose extending from a lower end portion of the housing, and is abuttable on a workpiece. The combustion chamber frame and the push lever are associated with each other by a connection unit including arm sections and a connector section. A compression coil spring for biasing the push lever downwardly is interposed between the connector section and a cylinder disposed in the housing. The housing covers the entire arm sections, the connector section and the spring, so that these components are not directly accessible from an outside.

8 Claims, 5 Drawing Sheets

COMBUSTION TYPE POWER TOOL HAVING SEGMENTAL CONNECTION UNIT

BACKGROUND OF THE INVENTION

The present invention relates to a combustion-type power tool having a combustion chamber frame, a push lever and a connection unit.

A conventional combustion-type driving tool such as a nail gun is disclosed in U.S. Pat. No. 5,197,646. In the disclosed driving tool, a spring serving as a biasing member is positioned at a lower portion of the tool for urging a push lever downwardly toward a workpiece. A spring seat protrudes from an outer peripheral surface of a cylinder, so that the spring is seated on the spring seat and interposed between the spring seat and a housing serving as an outer frame of the nail gun. The spring urges an arm portion provided integrally with the push lever for biasing the push lever downwardly.

In the above-described conventional combustion type power tool, since the spring is interposed between the outer peripheral surface of the cylinder and the housing for urging the push lever downwardly, a surplus space is required inside the housing for accommodation of the spring in the housing to inadvertently increase an outer diameter of the housing. The diameter of the housing can be reduced by reducing the diameter of the cylinder. However, the diameter of the piston reciprocally moved in the cylinder must also be reduced, if the diameter of the cylinder is reduced. Then, pressure applied to the piston is reduced due to the small diameter of the piston, which in turn, lowers output to lower the driving power.

Still however, the diameter of the housing must be as small as possible in case of a driving work at a specific working environment such as immediately beside a wall, even though the diameter of the housing cannot be set too small.

Further, in the combustion type power tool, the cylinder etc., are heated by the combustion heat because driving power is generated as a result of combustion of a fuel, and the exhaust gas is discharged through an exhaust hole formed in the cylinder. Since the arm portion is positioned nearby the cylinder, the arm portion is exposed to heat due to the heated cylinder, and the arm portion has high temperature. Moreover, since the exhaust hole is positioned near a connecting position between the push lever and the arm portion, the arm portion is exposed to the exhaust gas having a high temperature. In this connection, the arm portion must be made from a heat resistant material in addition to the general requirement of a mechanical strength. Stainless steel is used for the arm portion as a material for fulfilling these requirements.

Even though stainless steel has the above described performance, stainless steel is relatively expensive as a material cost. FIG. 6 shows a configuration of the arm portion which is made by punching a stainless steel plate, and FIG. 7 shows a punching arrangement for the arm portions. Since the arm portion is produced by bending an integral plate member formed by punching, residual surplus regions are provided in the steel plate after punching, which degrades yieldability.

Further, since the heated portion of the arm portion is exposed to an atmosphere, a user may burn himself if he may touch the heated portion.

SUMMARY OF THE INVENTION

It is therefore an object of the present invention to provide a combustion type power tool enhancing workability as well as enhancing yieldability to a material.

This and other objects of the present invention will be attained by a combustion-type power tool including a housing, a head section, a cylinder, a nose, a push lever, a piston, a combustion-chamber frame, a connection unit, and a biasing member. The head section is disposed near the one end of the housing and is formed with a fuel passage. The cylinder is secured to an inside of the housing. The nose extends downward from the lower end portion of the cylinder. The push lever is provided along the nose and is movable upon pushing onto a workpiece. The piston is slidably disposed in the cylinder and is reciprocally movable in an axial direction of the cylinder. The piston divides the cylinder into an upper cylinder space above the piston and a lower cylinder space below the piston. The combustion-chamber frame is movably provided in the housing. The combustion-chamber frame has one end abuttable on and separable from the head section in interlocking relation to the movement of the push lever. A combination of the combustion-chamber frame, the head section, and the piston defining a combustion chamber. The connection unit extends along the outer peripheral surface of the cylinder for mechanically associating the push lever with the combustion chamber frame. The connection unit includes at least two arm sections and a connector section. Each of the at least two arm sections has one end connected to the combustion chamber frame. The connector section is in abutment with the push lever. The other end of each arm section is connected to the connector section. The connection unit in its entirety is covered with the housing. The biasing member is disposed between the cylinder and the connector section.

Since the connection unit is provided by the connector section and separate arm sections, the connector section and the arm sections can be made independently of each other by punching plate members. Accordingly, yieldability for connector sections and for arm sections can be improved in the punching. Further, since the entire connection unit including the connector section and the arm sections assembled thereto is covered within the housing, the sliding component having a high temperature is not directly exposed to outside. Thus a user can be protected against direct touching to the high temperature component.

Preferably, the biasing member is at a position out of alignment with an axis of the cylinder. With this structure, a surplus space between the outer peripheral surface of the cylinder and the housing becomes unnecessary for installing the biasing member. As a result, a diameter of the housing can be reduced, and asssembleability of the combustion type power tool can be improved.

Preferably, the biasing member in its entirety is covered with the housing. With this structure, the compressive and expansive and high temperature component is not directly exposed to outside. Thus, the user is protected against the direct touching to the component.

In another aspect of the invention, there is provided a connection unit for connecting a combustion-chamber frame to a push lever in a combustion-type power tool, the connection unit including the at least two arm sections each having one end connected to the combustion chamber frame, each arm section having another end, and the separate connector section in association with the push lever, another end of each arm section being connected to the connector section.

DETAILED DESCRIPTION OF THE PREFERRED EMBODIMENTS

Figure 1:
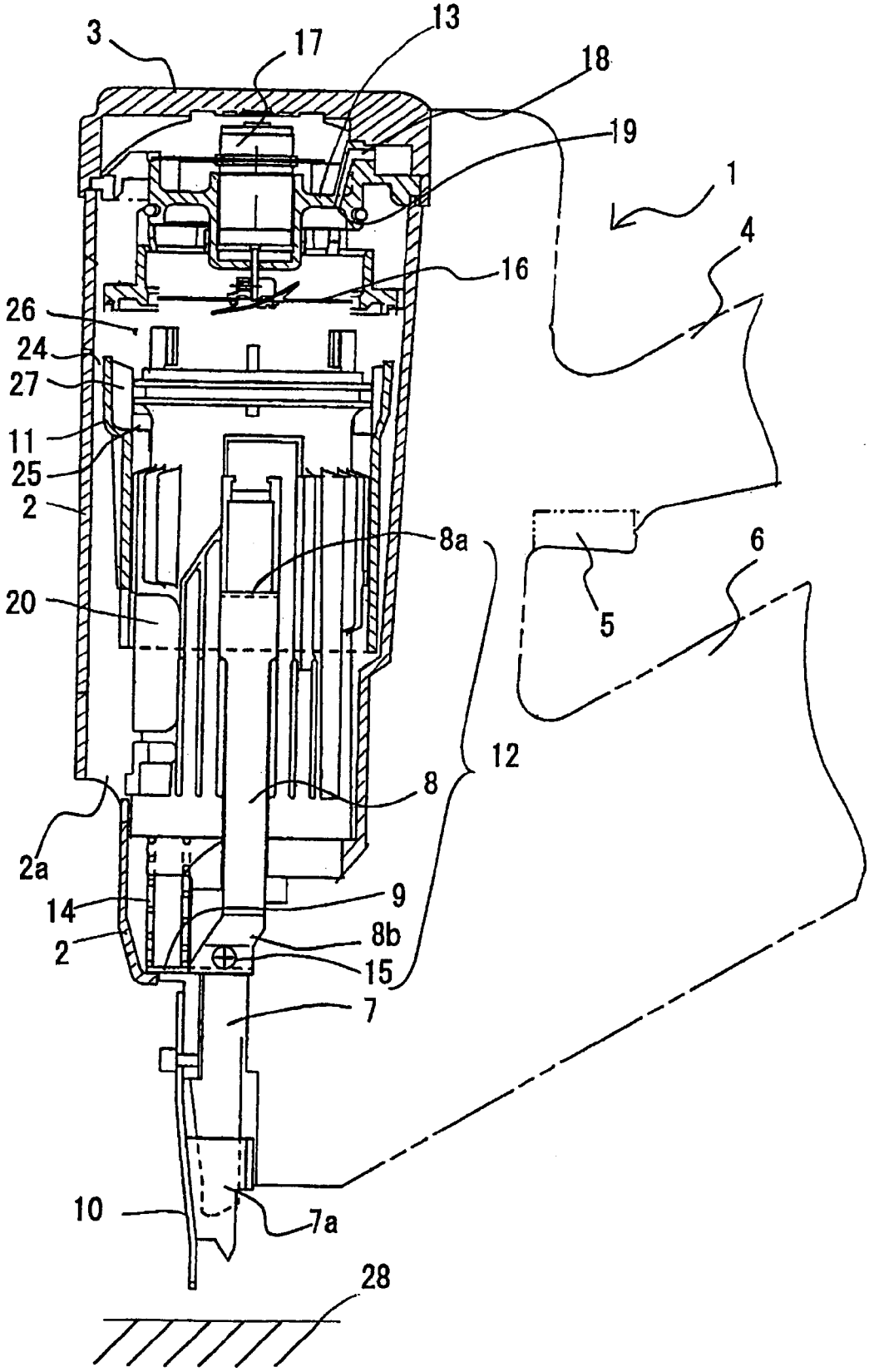
FIG. 1 is a cross-sectional side view showing a combustion type nail driving tool according to one embodiment of the present invention.

A combustion-type power tool according to one embodiment of the present invention will be described with reference to FIGS. 1 through 5. The embodiment pertains to a combustion type nail driver. The combustion type nail driver 1 shown in FIG. 1 has a housing 2 constituting an outer frame. The housing 2 has a lower portion formed with an exhaust port 2*a*. A head cover 3 formed with an intake port (not shown) is mounted on the top of the housing 2. A handle 4 extends from one side of the housing 2. The handle 4 has a trigger switch 5 and detachably accommodates therein a battery (not shown). A canister housing portion (not shown) is formed in the housing 2 and at the one side thereof from which the handle 4 extends. A gas canister (not shown) containing therein a combustible liquidized gas is detachably installable in the canister housing portion. A magazine 6 accommodating therein a bundle of nails (not shown) is disposed below the handle 4.

A nose 7 extends from near the lower end of the housing 2. The nose 7 is integral with a cylinder 20 described later and has a tip end abuttable on a workpiece 28. The nose 7 is adapted for guiding sliding movement of a driver blade 23A (FIG. 2) described later and for guiding the nail driven into the workpiece 28. A push lever 10 is reciprocally slidingly movably supported to the nose 7, and projects from the lower end 7*a* of the nose 7. The push lever 10 has an upper end in association with or abuttable on a connection unit 12 fixed to a combustion chamber frame 11 described later.

Figure 3:
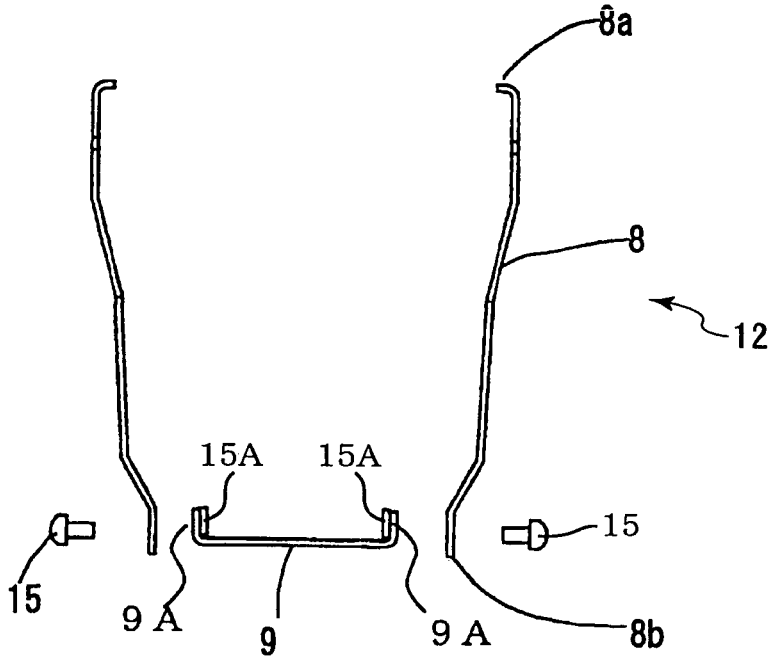
FIG. 3 is an exploded front view showing a connection unit in the combustion type nail driving tool according to the embodiment.
Figure 4:
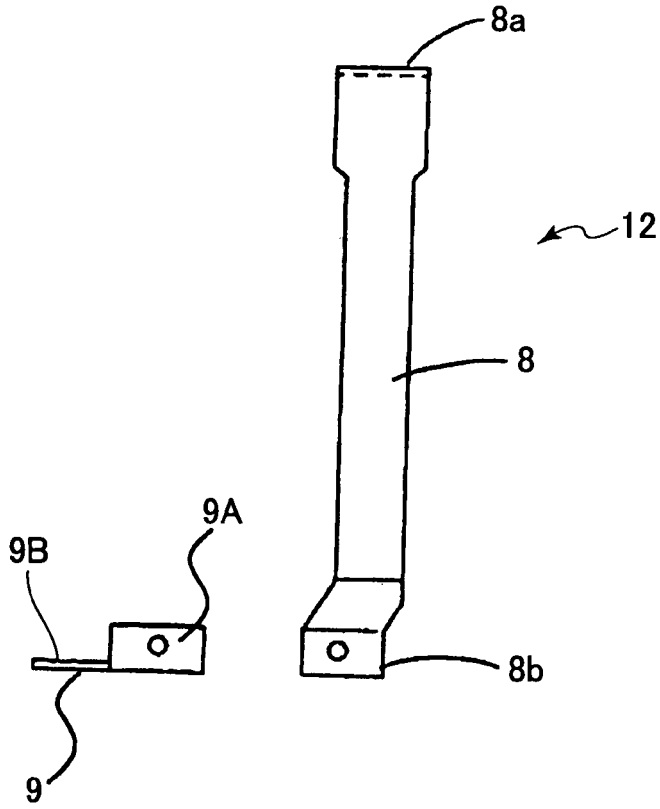
FIG. 4 is an exploded side view showing the connection unit in the combustion type nail driving tool according to the embodiment.

As shown in FIGS. 3 and 4, the connection unit 12 includes a pair of arm sections 8 each having stepwise bending portions, and a connector section 9 having a generally rectangular shape. Each upper end 8*a* of each arm section 8 is bent into L-shape. Each lower end 8*b* of each arm section 8 is fixed to the connector section 9 by means of screws 15 and nuts 15A. The connector section 9 has major sides each provided with an upstanding piece 9A at each end portion of the major side. Each upstanding piece 9A is formed with a thread hole with which each screw 15 is threadingly engageable. Each upstanding piece 9A is bent at an angle of substantially 90 degrees at each major side, so that two bent upstanding pieces 9A are in confronting relation to each other. The connector section 9 has a flat area 9B beside the upstanding pieces 9A. The flat area serves as a spring seat. The upper end of the push lever 10 is abuttable on the connector section 9.

Figure 5:
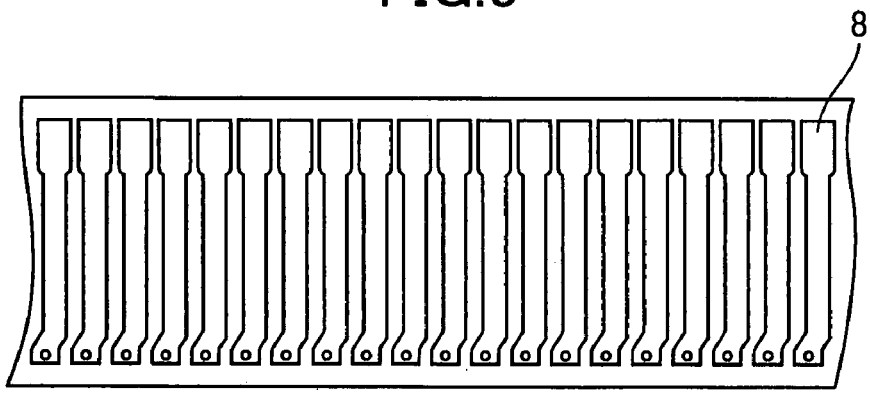
FIG. 5 is a view for description of a plane member to be punched for providing arm sections used in the combustion type nail driving tool according to the embodiment.
Figure 6:
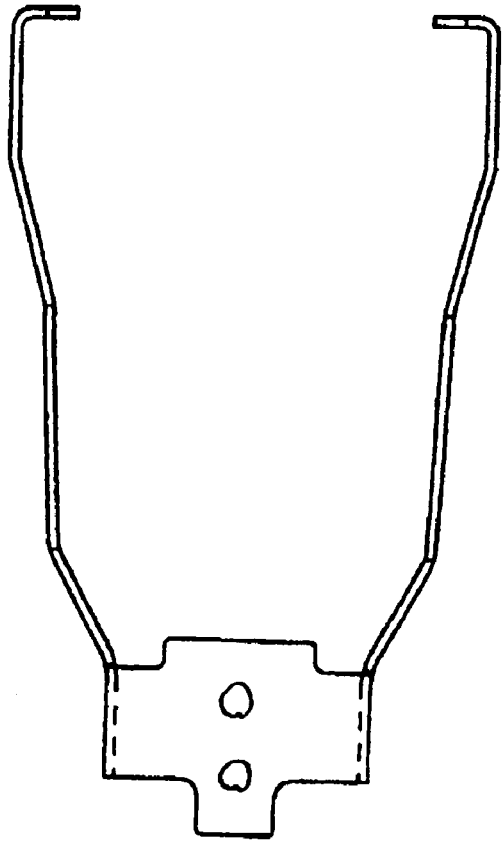
FIG.6 PRIOR ART
FIG. 6 is a front view showing an arm portion according to a conventional combustion type nail driving tool.
Figure 7:
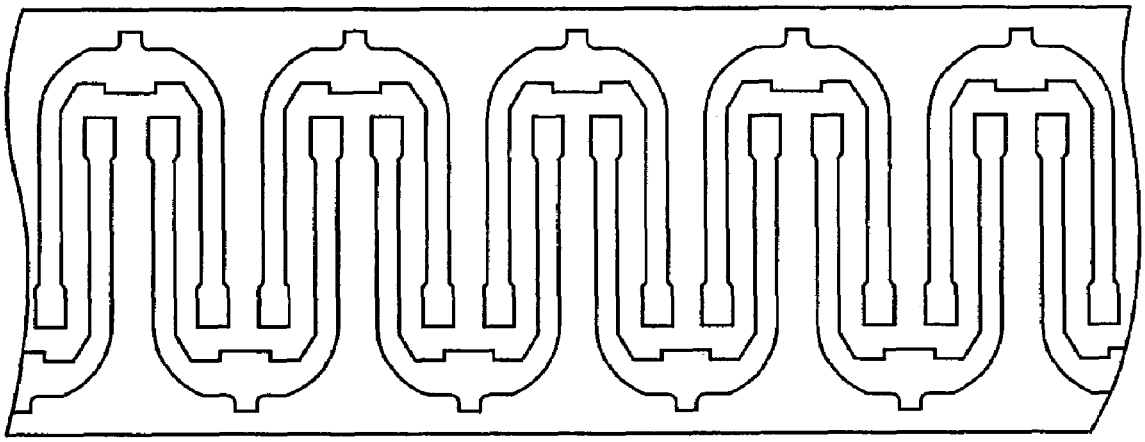
FIG.7 PRIOR ART
FIG. 7 is a view for description of a plane member to be punched for providing arm portions used in the conventional combustion type nail driving tool.

FIG. 5 shows the arm sections 8 to be punched out from a plate member made from a stainless steel. Because the arm sections 8 of the connection unit 12 are symmetrical shape with each other, punched out configuration of the arm sections are identical with one another. Accordingly, residual areas in the punched out stainless steel plate can be reduced, thereby enhancing material yieldability for producing the connection unit 12.

A compression coil spring 14 serving as a biasing member is interposed between the cylinder 20 and the spring seat 9B of the connector section 9 of the connection unit 12. Because the upstanding pieces 9A are disposed approximately in alignment with the axis of the cylinder 20 in a side view of FIG. 1, the spring seat 9B is disposed offset from the axis of the cylinder 20. Therefore, the compression coil spring 14 is positioned out of alignment with the axis of the cylinder 20.

Thus, the push lever 10 abuttingly associated with the connector section 9 is urged downwardly by the biasing force of the compression coil spring 14. The housing 2 extends to the position of the connector section 9. Therefore, the compression coil spring 14, the connector section 9 and the arm sections 8 threadingly connected to the connector section 9 are all accommodated within the housing 2. Morever, since the compression coil spring 14 is disposed offset from the axis of the cylinder 20, assembly of the compression coil spring 14 can be achieved at the final assembling process in comparison with the position of the conventional spring. Consequently, assembly and disassembly can be easily performed with respect to the compression coil spring 14. Furthermore, since the compression coil spring 14 is not disposed at a narrow space between the cylinder 20 and the housing 2, but is disposed at a special area, the diameter of the compression coil spring 14 can be increased. Thus, the lower portion of the housing 2 can has a smaller size for accommodation of the compression coil spring 14. This is advantageous in designing the compression coil spring 14 in terms of its biasing strength etc.

A head cap 13 serving as a head section is secured to the top of the housing 2 and closes the open top end of the housing 2. The head cap 13 supports a motor 17 for rotating a fan 16. The head cap 13 also supports an ignition plug (not shown) ignitable upon manipulation to the trigger switch 5. A head switch (not shown) is provided in the housing 2 for detecting an uppermost stroke end position of the combustion chamber frame 11 described later when the power tool 1 is pressed against the workpiece 28. Thus, the head switch can be turned ON when the push lever 10 is elevated to a predetermined position for starting rotation of the motor 17, thereby starting rotation of the fan 16.

The head cap 13 has a handle side in which is formed a fuel ejection passage 18 which allows a combustible gas to pass therethrough. One end of the ejection passage 18 serves as an ejection port 19 that opens at the lower surface of the head cap 13. Another end of the ejection passage 18 serves as a gas canister connecting portion in communication with a gas canister (not shown).

The combustion-chamber frame 11 is provided in the housing 2 and is movable in the lengthwise direction of the housing 2. The uppermost end of the combustion-chamber frame 11 is abuttable on the lower surface of the head cap 13. A protrusion 11*b* protrudes readially inwardly from an inner peripheral surface of the combustion chamber frame 11. Each upper end 8*a* of each arm section 8 is engaged with or fixed to the protrusion 11*b*, so that the combustion chamber frame 11 and the connection unit 12 are connected together.

As described above, since the connection unit 12 is connected to the combustion chamber frame 11 and to the push lever 10 particularly during pressing the tool 1 against the workpiece 28, the combustion chamber frame 11 is moved in accordance with the movement of the push lever 10. The cylinder 20 is fixed to the housing 2. An outer peripheral surface of the cylinder 20 is in sliding contact with the inner circumference of the combustion-chamber frame 11 for guiding the movement of the combustion-chamber frame 11. The cylinder 20 has an axially intermediate portion formed with an exhaust hole 21. An exhaust-gas check valve (not shown) is provided to selectively close the exhaust hole 21.

Figure 2:
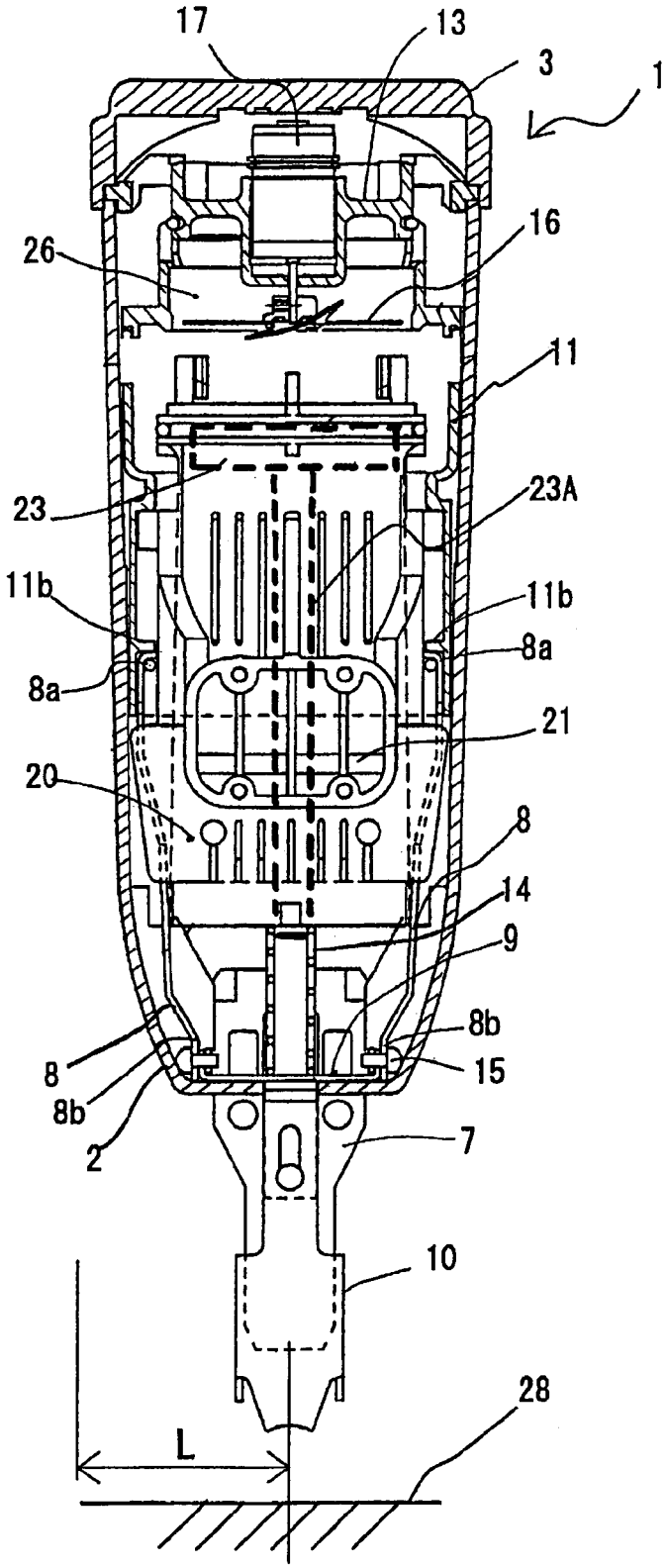
FIG. 2 is a cross-sectional front view showing the combustion type nail driving tool according to the embodiment.

As shown in FIG. 2, a piston 23 is slidably and reciprocally movably provided in the cylinder 20. The piston 23 divides an inner space of the cylinder 20 into an upper space above the piston 23 and a lower space below the piston 23. The driver blade 23A extends downwards from a lower side of the piston 23, the side being at the cylinder space below the piston, to the nose 7, so that a tip end of the driver blade 23A can strike against the nail (not shown). When the upper end of the combustion-chamber frame 11 abuts on the head cap 13, the head cap 13, the combustion-chamber frame 11, and the upper cylinder space above the piston 23 define in combustion a combustion chamber 26. When the combustion chamber frame 11 is separated from the head cap 13, a first flow passage 24 in communication with the atmosphere is provided between the head cap 13 and the upper end of the combustion chamber frame 11, and a second flow passage 25 in communication with the first flow passage 24 is provided between the combustion chamber frame 11 and the upper end portion of the cylinder 20. The second flow passage 25 allows a combustion gas and a fresh air to pass along the outer peripheral surface of the cylinder 20 for discharging these gas through the exhaust port 2*a* of the housing 2*a*. Further, the above-described intake port is formed for supplying a fresh air into the combustion chamber 26, and the exhaust hole 21 is adapted for discharging combustion gas generated in the combustion chamber 26.

At a lower side of the cylinder 20, a bumper (not shown) is provided against which the piston 23 strikes. The bumper is adapted to absorb a kinetic energy of the piston 23 during its movement toward its bottom dead center.

As shown in FIG. 1, the plurality of ribs 27 are disposed in the combustion chamber frame 11 and at a region defining the combustion chamber 26. Each rib 27 extends in an axial direction of the combustion chamber frame 11, and protrudes radially inwardly. These ribs 27 are adapted for promoting agitation of the combustible gas with air in cooperation with the rotation of the fan 16 in the combustion chamber 26.

The fan 16 and the fuel ejection port 19 are disposed in or open to the combustion chamber 26. Rotation of the fan 16 performs the following three functions. First, the fan stirs and mixes the air with the combustible gas as long as the combustion-chamber frame 11 remains in abutment with the head cap 13. Second, after the mixed gas has been ignited, the fan 16 causes turbulence of the air-fuel mixture, thus promoting the turbulent combustion of the air-fuel mixture in the combustion chamber 26. Third, the fan performs scavenging such that the exhaust gas in the combustion chamber 26 can be scavenged therefrom and also performs cooling to the combustion chamber frame 11 and the cylinder 20 when the combustion-chamber frame 11 moves away from the head cap 13 and when the first and second flow passages 24, 25 are provided.

Operation of the combustion type nail driver 1 will next be described. In non-operational state of the combustion type nail driver 1, the push lever 10 is biased downward by the biasing force of the compression coil spring 14, so that the push lever 10 protrudes from the lower end of the nose 7. Thus, the uppermost end of the combustion-chamber frame 11 is spaced away from the head cap 13 because the combustion-chamber frame 11 is in association with the push lever 10 through the connection unit 12. Further, a part of the combustion-chamber frame 11 which part defines the combustion chamber 26 is also spaced from the top portion of the cylinder 20. Hence, the first and second flow passages 24 and 25 are provided. In this condition, the piston 23 stays at the top dead center in the cylinder 20.

With this state, if the push lever 10 is pushed onto the workpiece 28 while holding the handle 4 by a user, the push lever 10 is moved upward against the biasing force of the compression coil spring 14. At the same time, the combustion-chamber frame 11 which is connected to the push lever 10 through the connection unit 12 is also moved upward, closing the above-described flow passages 24 and 25. Thus, the sealed combustion chamber 26 is provided.

In accordance with the movement of the push lever 10, the gas canister (not shown) is tilted toward the head cap 13 by an action of a cam (not shown). Thus, the injection rod (not shown) of the gas canister is pressed against the connecting portion of the head cap 13. Therefore, the liquidized gas in the gas canister is ejected once into the combustion chamber 26 through the ejection port 19.

Further, in accordance with the movement of the push lever 10, the combustion chamber frame 11 reaches the uppermost stroke end whereupon the head switch is turned ON to start rotation of the fan 16. Rotation of the fan 16 and the ribs 27 protruding into the combustion chamber 26 cooperate, stirring and mixing the combustible gas with air in the combustion chamber 26 in order to form a combustion gas. In this state, when the trigger switch 5 provided at the handle 4 is turned ON, spark is generated at the ignition plug (not shown) to ignite the combustible gas.

As a result of combustion, volumetric expansion of the combustion gas occurs within the combustion chamber 26 to move the piston 23 donwwardly. Accordingly, the driver blade 23A drives the nail held in the nose 7 into a workpiece until the piston 23 strikes against the bumper (not shown).

After the nail driving, the piston 23 strikes against the bumper, and the combustion gas is discharged out of the cylinder 20 through the exhaust hole 21 of the cylinder 20. When the inner space of the cylinder 20 and the combustion chamber 26 becomes the atmospheric pressure, the check valve (not shown) provided at the exhaust hole 21 is closed.

Combustion gas still remaining in the cylinder 20 and the combustion chamber 26 has a high temperature at a phase immediately after the combustion. The heat is absorbed through the inner surfaces of the cylinder 20 and the combustion chamber frame 11, and the temperature of these components is also increased. However, the absorbed heat is released to the atmosphere through the outer surfaces of the cylinder 20 and the combustion-chamber frame 11.

In this case, since the arm sections 8 are connected to the combustion chamber frame 11, and are disposed adjacent to the cylinder 20, temperature of the arm sections 8 and the connector section 9 connected thereto also becomes high temperature similar to the cylinder 20 etc. Further, since the compression coil spring 14 is in abutment with the lower end of the cylinder 20, the temperature of the spring 14 is also increased through heat transmission from the cylinder 20.

Combustion heat of the combustion gas is thus absorbed into these components such as the cylinder 20, so that a volume of the combustion gas is decreased. Thus, the pressure in the sealed space in the cylinder 20 above the piston 23 further drops to less than the atmospheric pressure (creating a so-called "thermal vacuum"). Accordingly, the piston 23 is moved back to the initial top dead center position.

The arm sections 8, the connector section 9 and the compression coil spring 14 are movable components in interlocking relation to the sliding movement of the push lever 10. However, since these components are covered by the housing 2, the housing 2 can prevent the user from directly touching these components.

Then, the trigger switch 5 is turned OFF, and the user lifts the combustion type nail driver 1 from the workpiece 28 for separating the push lever 10 from the workpiece 28. As a result, the push lever 10 and the combustion-chamber frame 11 move downward due to the biasing force of the compression coil spring 14 to restore the state shown in FIG. 1. In this case, the fan 16 keeps rotating for a predetermined period of time in spite of OFF state of the trigger switch 5 because of an operation of a control portion (not shown). In the state shown in FIG. 1, the flow passages 24 and 25 are provided again at the upper side of the combustion chamber frame 11, so that fresh air flows into the combustion chamber 26 through the intake port (not shown) formed in the head cover 3 and through the flow passages 24, 25, expelling the residual gas through the exhaust port 2*a* by the rotation of the fan 16. Thus, the combustion chamber is scavenged. Then, the rotation of the fan 16 is stopped to restore an initial stationary state. Thereafter, subsequent nail driving operation can be performed by repeating the above described operation process.

In the combustion type nail driver 1, since the compression coil spring 14 is not disposed over the outer peripheral surface of the cylinder 20, the diameter of the housing 2 can only be slightly greater than the diameters of the cylinder 20 ignoring the compression coil spring 14. Accordingly, as shown in FIG. 2, a distance L between the outer peripheral surface of the housing 2 and a central position of the push lever 10, i.e., the nail driving position can be reduced in comparison with the conventional combustion type nail driver. That is, the outer diameter of the housing 2 can be reduced. With this arrangement, amount of a material used for the tool 1 can be reduced, and further, a driving work at a narrow area to which the conventional tool cannot be accessed or at an area immediately beside an upstanding wall can be achieved, and thus, enhanced workability can result along with the above-described safety.

What is claimed is:

1. A combustion-type power tool comprising:

a housing having one end;

a head section disposed near the one end of the housing and formed with a fuel passage;

a cylinder secured to an inside of the housing, the cylinder having a lower end portion and an outer peripheral surface;

a nose extending downward from the lower end portion;

a push lever provided along the nose and movable upon pushing onto a workpiece;

a piston slidably disposed in the cylinder and reciprocally movable in an axial direction of the cylinder, the piston dividing the cylinder into an upper cylinder space above the piston and a lower cylinder space below the piston;

a combustion-chamber frame movably provided in the housing, the combustion-chamber frame having one end movable so as to abut the head section in one position and to be separated from the head section in an other position in interlocking relation to the movement of the push lever, a combination of the combustion-chamber frame, the head section and the piston defining a combustion chamber;

a connection unit extending along the outer peripheral surface of the cylinder for mechanically associating the push lever with the combustion chamber frame, the connection unit comprises at least two arm sections each having one end connected to the combustion chamber frame, each arm section having another end, and a connector section in abutment with the push lever, the another end of each arm section being connected to the connector section, the connection unit in its entirety being covered with the housing; and a biasing member disposed between the cylinder and the connector section;

wherein the biasing member is at a position out of alignment with an axis of the cylinder.

2. A combustion-type power tool comprising:

a housing having one end;

a head section disposed near the one end of the housing and formed with a fuel passage;

a cylinder secured to an inside of the housing, the cylinder having a lower end portion and an outer peripheral surface;

a nose extending downward from the lower end portion;

a push lever provided along the nose and movable upon pushing onto a workpiece;

a piston slidably disposed in the cylinder and reciprocally movable in an axial direction of the cylinder, the piston dividing the cylinder into an upper cylinder space above the piston and a lower cylinder space below the piston;

a combustion-chamber frame movably provided in the housing, the combustion-chamber frame having one end movable so as to abut the head section in one position and to be separated from the head section in an other position in interlocking relation to the movement of the push lever, a combination of the combustion-chamber frame, the head section and the piston defining a combustion chamber;

a connection unit extending along the outer peripheral surface of the cylinder for mechanically associating the push lever with the combustion chamber frame, the connection unit comprises at least two arm sections each having one end connected to the combustion chamber frame, each arm section having another end, and a connector section in abutment with the push lever, the another end of each arm section being connected to the connector section, the connection unit in its entirety being covered with the housing; and a biasing member disposed between the cylinder and the connector section;

wherein the connector section comprises a spring seat section on which the biasing member is seated, and a pair of upstanding sections to which the another end of a respective arm section being connected to a respective one of the pair of upstanding sections, the spring seat section being offset from an axis of the cylinder.

3. The combustion-type power tool asclaimed in claim 2, wherein the biasing member in its entirety is covered with the housing.

4. The combustion-type power tool as claimed in claim 2, wherein the another end of each arm section is connected to the connector section by a fastener.

5. A connection unit for connecting a combustion-chamber frame to a push lever in a combustion-type power tool, the connection unit comprises:

at least two arm sections each having one end connected to the combustion chamber frame, each arm section having another end;

a separate connector section in association with the push lever, the another end of each arm section being connected to the connector section;

wherein the combustion-type power tool further comprises a cylinder and a biasing member disposed between the cylinder and the connector section; and wherein the connector section comprises a spring seat section on which the biasing member is seated, and a pair of upstanding sections to which the another end of a respective arm section being connected to a respective one of the pair of upstanding sections, the spring seat section being offset from an axis of the cylinder.

6. The connection unit as claimed in claim 5, wherein the combustion-type power tool has a housing, and wherein the connection unit in its entirety is covered with the housing.

7. The connection unit as claimed in claim 5, wherein the another end of each arm section is connected to the connector section by a fastener.

8. A combustion-type power tool comprising:

a housing having one end;

a head section disposed near the one end of the housing and formed with a fuel passage;

a cylinder secured to an inside of the housing, the cylinder having a lower end portion and an outer peripheral surface;

a nose extending downward from the lower end portion;

a push lever provided along the nose and movable upon pushing onto a workpiece;

a piston slidably disposed in the cylinder and reciprocally movable in an axial direction of the cylinder, the piston dividing the cylinder into an upper cylinder space above the piston and a lower cylinder space below the piston;

a combustion-chamber frame movably provided in the housing, the combustion-chamber frame having one end movable so as to abut the head section in one position and to be separated from the head section in an other position in interlocking relation to the movement of the push lever, a combination of the combustion-chamber frame, the head section and the piston defining a combustion chamber;

a connection unit extending along the outer peripheral surface of the cylinder for mechanically associating the push lever with the combustion chamber frame, the connection unit comprises at least two arm sections each having one end connected to the combustion chamber frame, each arm section having another end, and a connector section in abutment with the push lever, the another end of each arm section being connected to the connector section, the connection unit in its entirety being covered with the housing; and a biasing member disposed between the cylinder and the connector section;

wherein the biasing member has an axis, and the axis of the biasing member is offset from an axis of the cylinder.

* * * * *